United States Patent [19]

Bogler et al.

[11] 3,983,678

[45] Oct. 5, 1976

[54] METHOD AND APPARATUS FOR CHARGING A HYDRO-PNEUMATIC RESERVOIR WITH GAS UNDER PRESSURE

[75] Inventors: Peter Bogler, Voelkingen; Wilhelm Gerhardt, Niederwuerzbach, both of Germany

[73] Assignee: Greer Hydraulics, Inc., Los Angeles, Calif.

[22] Filed: Dec. 5, 1975

[21] Appl. No.: 637,968

[30] Foreign Application Priority Data

Dec. 5, 1974 Germany ..... 2457501

[52] U.S. Cl. ..... 53/7; 53/88; 53/101

[51] Int. Cl.[2] ..... B65B 31/04

[58] Field of Search ..... 53/7, 88, 89, 97, 101

[56] References Cited

UNITED STATES PATENTS 3,057,131 10/1962 McKinley et al. ..... 53/88

FOREIGN PATENTS OR APPLICATIONS 1,196,020 7/1965 Germany ..... 53/88

*Primary Examiner*—Travis S. McGehee
*Attorney, Agent, or Firm*—Arthur B. Colvin

[57] ABSTRACT

The invention relates to a method and apparatus for charging a hydro-pneumatic reservoir with gas under pressure. The reservoir is positioned between two vertically aligned supporting members, with the oil charging port and gas charging port of the reservoir axially aligned. The supporting member on which the oil charging port is positioned, is vertically adjustable. The gas charging port carries an initially loose fitting bushing with an expander member at its outer end, the bushing permitting flow of gas therearound to permit charging of the reservoir. A force applying member is slidably mounted in the uppermost supporting member such that when gas under pressure is applied, it will cause the force applying member to move upwardly and the gas under pressure will pass around the bushing into the reservoir to charge the latter. After the reservoir is charged, oil under pressure is applied to the force applying member to move the latter downwardly to react against the expander member, forcing the latter into the bushing to expand the latter and seal the gas port of the reservoir.

11 Claims, 6 Drawing Figures

FIG. 4
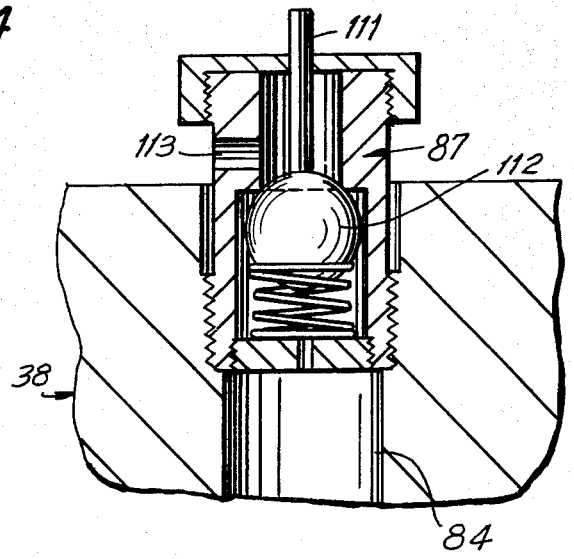
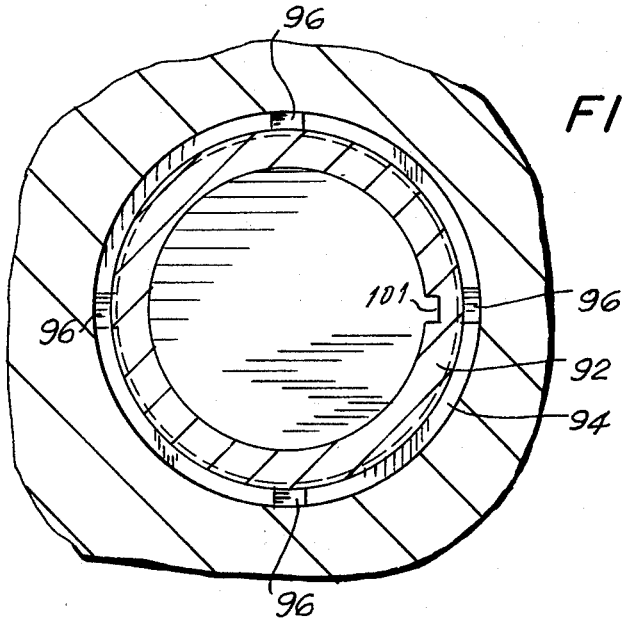
FIG. 5
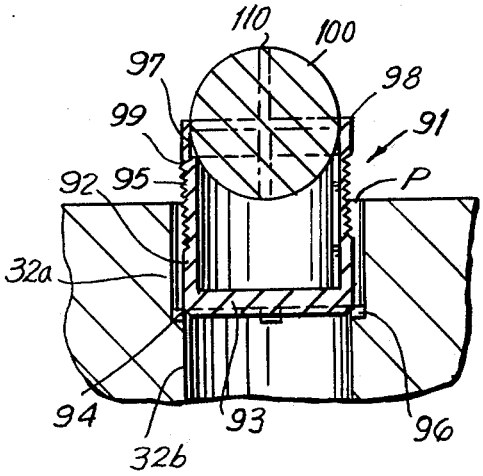
FIG. 6

METHOD AND APPARATUS FOR CHARGING A HYDRO-PNEUMATIC RESERVOIR WITH GAS UNDER PRESSURE

It is among the objects of the invention to provide a method and apparatus for charging a pressure vessel such as a hydro-pneumatic reservoir with gas under pressure and thereupon sealing the gas charging port, which method may readily be performed by relatively simple apparatus requiring relatively few parts which may readily be assembled and which may readily be operated dependably to charge a pressure reservoir and permanently seal the gas charging port.

According to the invention, these objects are accomplished by the arrangement and combination of elements hereinafter described and more particularly recited in the claims.

In the accompanying drawings in which is shown one of various possible embodiments of the several features of the invention:

FIG. 4 is a detail sectional view taken along line 4—4 of FIG. 1;

FIG. 5 is a view similar to FIG. 4 taken alone line 5—5 of FIG. 1, and FIG. 6 is a fragmentary detail view on an enlarged scale showing the sealing bushing in its initial position in the gas port.

Figure 1:
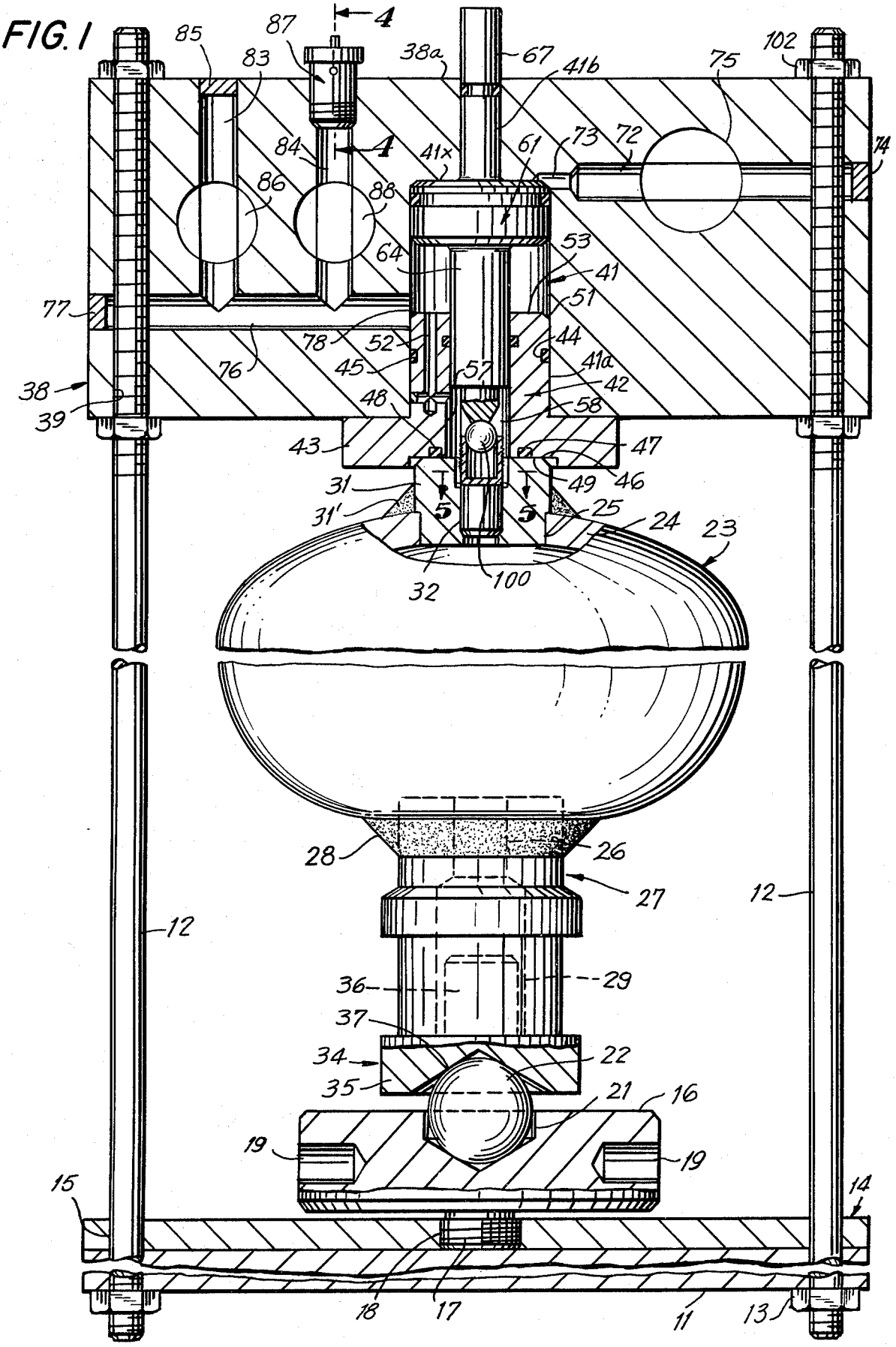
FIG. 1 is a fragmentary front elevational view of the apparatus with parts broken away and partly in cross section showing the pressure reservoir in position for charging with gas under pressure.

Referring now to the drawings, the charging equipment comprises a base plate 11 from which extends upwardly tie rods 12 held in place by nuts 13. A lower cross beam 14 having openings 15 through which the tie rods 12 extend, is positioned on the base plate 11.

A support block 16 is provided which has a depending threaded stud 17 that is screwed into an appropriately threaded opening 18 in the lower cross beam 14. The support block 16 normally rests on the cross beam 14 and can be rotated by means of a spanner wrench, for example, coacting with suitable openings 19 in the side of the support block 16.

The support block 16 has a recess 21 axially aligned with the threaded stud 17 which is adapted to receive a ball 22.

The hydro-pneumatic reservoir 23 which is to be charged, may be of any conventional type and comprises a rigid container 24 having a deformable separator therein (not shown) which divides the container into two chambers. One of the chambers is designed to be charged with gas under pressure through a gas port 25 and the other with oil under pressure through oil port 26.

An oil port fitting 27 is secured to the container 24 axially aligned with the oil port 26. Although the oil port fitting 27 can be secured to the container in any suitable manner, it is illustratively welded thereto as at 28. The oil port fitting 27 has an internal bore 29 of enlarged diameter at its outer end and such outer end is internally threaded.

The gas port 25 of container 24 is axially aligned with oil port 26. Rising from the container 24 is a gas fitting 31 which is secured to the container as by welding at 31'. The gas fitting 31 has a bore 32 therethrough with three stepped portions **32*a*, 32*b* and 32*c* of progressively decreasing diameter the bore portion 32*a* being of larger diameter than the bore portion 32*c*. The bore 32 is axially aligned with the gas port 25**.

To mount the reservoir 23 on the charging apparatus, an adaptor 34 is provided, which, as shown in FIG. 1, has a head or base portion 35 from which rises a cylindrical stud 36. The outer surface of head 35 has a recess 37, which is conical in cross section, the recess being axially aligned with the stud 36. The adaptor 34 is connected to the reservoir 23 by positioning the stud 36 of the adaptor 34 into the enlarged diameter bore portion 29 of the fitting 27.

The tie rods 12 support an upper holding member in the form of a cross beam 38, the tie rods extending through associated bores 39 in the cross beam 10 as shown in FIG. 1.

As shown in FIG. 1, the support member 38 has an axial bore 41 axially aligned with bore 18 in support member 14. The bore 41 has an enlarged diameter portion **41*a* at its lower end and a smaller diameter portion 41*b* at its upper end. Slidably mounted in the lower portion 41*a* of the bore 41 is a sealing piston 42 which has an annular flange or collar 43 of enlarged diameter at its outer end. The piston 42 has an annular groove 44 in its outer periphery in which an "0" ring 45 is mounted to provide a seal with respect to the adjacent surface of bore 41. The bottom surface 46 of collar 43 has an annular groove 47 in which an "0" ring 48 is positioned to define a seal with respect to the end 49 of gas fitting 31**.

Figure 2:
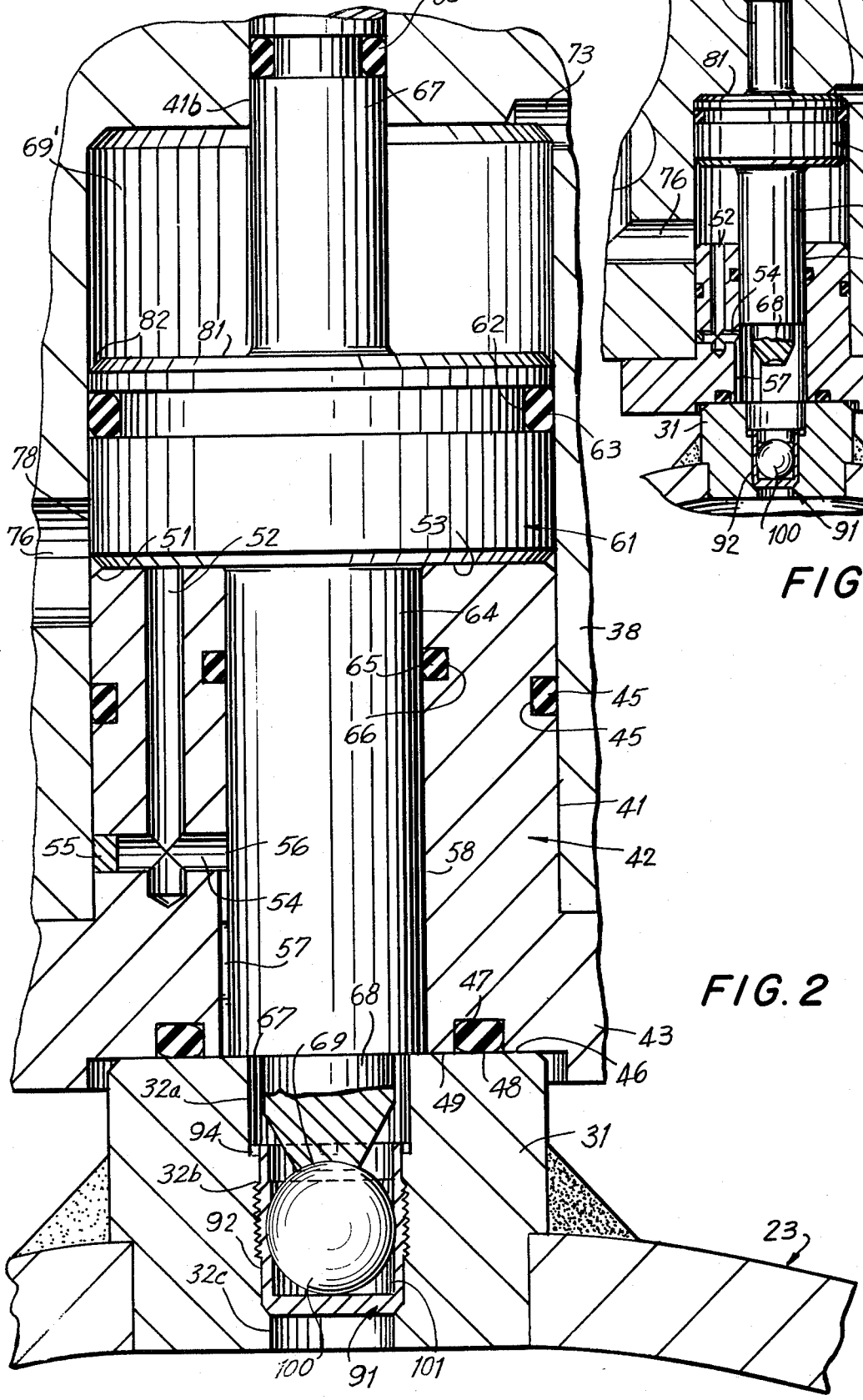
FIG. 2 is a detail view similar to FIG. 1 showing the apparatus after the reservoir has been charged with gas under pressure and the gas port sealed.

The piston 42 has a chamfered outer periphery as at 51 and a bore or passageway 52 extends longitudinally from the outer end 53 of piston 42 as shown in FIGS. 1 and 2. The bore 52 terminates in a cross passageway 54 closed at its outer end as at 55 and having its inner end 56 in communication with a longitudinal groove 57 in the axial bore 58 of the piston 42.

Slidably mounted in the bore 41 of support 38 is a piston 61 which has an annular peripheral groove 62 in which an "0" ring 63 is positioned to define a seal. The piston 61 has a cylindrical axial piston rod 64 depending therefrom and slidably mounted in bore 58 of piston 42, an "0" ring 65 positioned in an annular groove 66 in bore 58 defining a seal with respect to the piston rod 64. The outer end 67 of piston rod 64 has an axial stud 68, the end of which is concave as at 69.

The piston 61 also has a piston rod 67 rising therefrom and axially aligned therewith, which extends through the reduced diameter bore portion **41*b* and an "0" ring 68' encompassing the piston rod 67 defines a seal with respect to bore portion 41*b*. The space between the piston 61 and the upper end 71 of the bore 41 defines a fluid chamber 69'**.

A passageway 72 in the upper support 38 leads into the upper portion of the chamber 69' as at 73, the outer end of passageway 72 being sealed as at 74. A cross passageway 75 in the support 38 has one end connected to the passageway 72 and the other end (not shown) is designed to be connected to a source of fluid under pressure. An additional passageway 76 is provided, in the support 38 which is closed at its outer end as at 77 and has its inner end leading into the bore 41 as at 78. It is to be noted that the periphery of piston 61 adjacent the end 81 thereof is chamfered as at 82.

The support 38 has two vertical parallel passageways 83, 84, each having one end leading into the passageway 76. The passageway 83 has its outer end closed by a plug 85 and a cross passageway 86 is provided in support 38 having its outer end (not shown) adapted to be connected to a source of gas under pressure. The passageway 84 has a venting plug 87 (FIGS. 1 and 4) screwed in its outer end and a cross passageway 88 is provided to which a pressure gauge may be connected.

Prior to mounting the reservoir 23 on the charging apparatus in the manner to be described, a sealing member 91 is positioned in the bore 32 of gas fitting 31, as shown in the drawings (FIG. 6). The sealing member 91 comprises a cylindrical bushing 92 which has a bottom wall or floor 93, having its periphery seated on the shoulder 94 defined by the step portion 32*b*. The bushing 92 fits relatively loosely in the bore portion 32*a* and the outer surface of the bushing has circumferential grooves 95 of triangular profile defining sharp edges, the function of which will be hereinafter described. As the bushing fits relatively loosely in the bore portion 32*a*, it is apparent that a passageway P for gas under pressure is provided between the outer surface of the bushing 92 and the wall of bore portion 32*a* so that such gas under pressure may flow through the bore portions 32*b* and 32*c* into the pressure reservoir 23 to charge the latter. To facilitate flow of gas through the passageway P, the annular shoulder 94 is provided with a plurality of notches 96 as shown in FIGS. 5 and 6.

As shown in FIG. 6, the bushing 92 has an enlarged diameter portion 97 at the end 98 thereof remote from floor 93 defining a seat 99 for an expander ball 100. In addition, the inner wall surface of the bushing has one or more longitudinal grooves 101, the function of which will be hereinafter described.

The reservoir 23 with the adaptor 34 mounted in the oil port fitting 27 thereof is positioned on the support block 16 so that the ball 22 is sandwiched between the conical recesses 21 and 37 as shown in FIG. 1. Thereupon, the upper support member 38 is positioned on the tie rods 12 as shown in FIG. 1 and the nuts 102 are secured on the threaded ends of the tie rods, the reservoir being supported in the manner now to be described.

When the equipment is set up, the expander ball 100 is in the position shown in FIGS. 1 and 6, i.e., resting on the seat 99. The collar 43 is seated on the end 49 of the gas fitting 31 as shown and with the upper support member 38 held in place by the nuts 102, the support block 16 is rotated so that it will move upwardly to the position shown in FIG. 1 with the reservoir 23 retained between the head collar 43 of the sealing piston 42 and the support block 16.

Thereupon a control valve (not shown) is opened to connect the passageway 86 and the passageways 83 and 76 to a source of gas under pressure. The gas will flow into the bore 41 of support 38 and into the space between the piston 61 and the piston 42. Since collar 43 of piston 42 is abutting against the end 49 of the fitting 31 it is restrained from downward movement. The resulting force caused by the gas under pressure will cause the piston 61 to move upwardly to the position shown in FIG. 1 with the piston rod 67 protruding from the bore portion 41*b* to indicate that the equipment is in filling mode.

When the piston 61 abuts against the end 41*x* of the bore 41 no further upward movement of the piston 61 can occur. As the gas pressure builds up and reacts against the end 53 of piston 42, it will force the surface 46 thereof against the end 49 of the gas fitting 31 so that "0" ring 48 will provide a dependable seal.

The gas under pressure will also flow through passageway 52 and will pass between the bushing 92 resting on shoulder 94, and the bore portion 32*a* and will flow through bore portions 32*b* and 32*c* into the reservoir 23 to charge the latter.

After the desired pressure is obtained in the reservoir 23 which can be read on the pressure gauge (not shown) connected to passageway 88, the gas supply is shut off by means of the control valve previously mentioned, but not shown.

At this time fluid such as oil under pressure, is forced through passageway 75 to flow through passageway 72 into the opening 73 to react against the piston 61. As a result, the piston 61 will be moved downwardly as shown in FIG. 2, causing corresponding movement of the piston rods 67 and 64. Consequently, the stud 68 will react against the expander ball 100 to force the latter into the bushing 92. As the diameter of the expander ball 100 is greater than the inner diameter of the bushing 91, as the expander ball 100 is moved downwardly into the bushing 91 it will cause the side wall of the bushing to move outwardly so that the relatively sharp edges of grooves 95 will bite into the wall of bore portion 32*b* to provide a dependable gas-tight seal as shown in FIG. 2.

Figure 3:
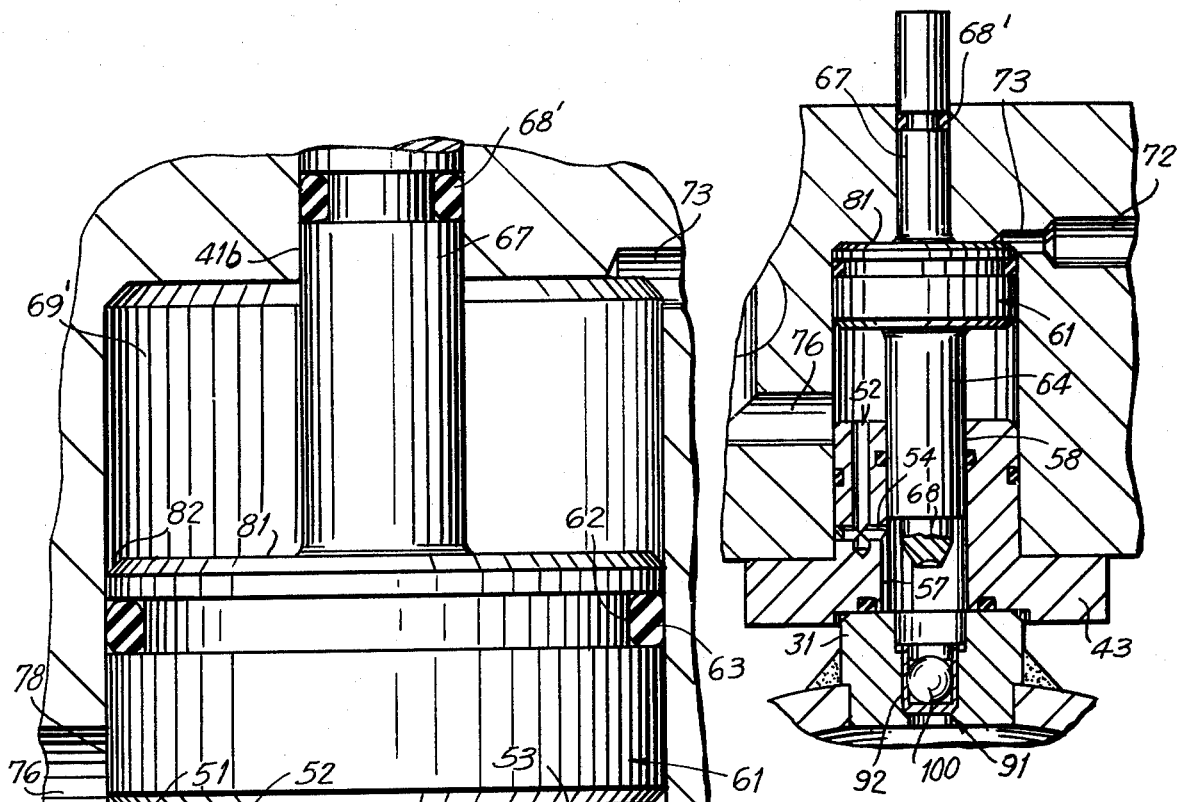
FIG. 3 is a view similar to FIG. 2, but showing the force applying member in withdrawn position after the gas port is sealed.

It is to be noted that as the expander ball 100 moves into the bushing 91, referring to FIG. 3, if no means were provided to vent the gas in the bushing between the ball 100 and floor 93 that is being compressed by the movement of the expander ball 100, the latter might not enter into the bushing 91, properly and could possibly be ejected. However, venting is provided in the embodiment shown, by the groove 101 in the bushing which permits passage of the gas from one side of the ball to the other.

If desired, instead of such groove 101, the expander ball 100 itself could be provided with a plurality of cross passageways 110 (shown in broken lines in FIG. 6), which would insure that at least one passageway would be provided from one side of the expander ball to the other to vent the bushing. In such case, the groove 101 could be eliminated.

When the expander ball has been moved downwardly to its final position, at such time the outer end of piston rod 67 will be substantially flush with the top surface 38*a* of upper support 38 to serve as an indication that the reservoir has been charged and that the gas port has been sealed. Thereupon, the gas under pressure in passageway 86 is cut off as is the source of fluid under pressure into passageway 75 and the passageway is connected to exhaust. As a result of the gas under pressure in passageway 76 and in the bore portion 32*a*, the piston 61 will be moved from the position shown in FIG. 2 to the position shown in FIG. 3, the fluid in the chamber 69′ being forced through opening 73 and passageway 75 to exhaust. To complete the cycle, the gas under pressure remaining in the system is vented by depressing the pressure relief pin 111 shown in FIG. 4. This will cause the one way ball valve 112 to move off its seat to provide a path for flow of gas from passageway 84 through vent port 113.

The charged reservoir 23 is then removed from the charging equipment by rotating the support block 16 to lower the latter which will cause the reservoir 23 to move vertically away from the support collar 43 so that it may then be moved laterally for removal.

It is within the scope of the invention to accommodate reservoirs of different lengths by inserting adaptors between the base plate 11 and the lower cross beam 14.

Having thus described my invention, what I claim as new and desire to secure by Letters Patent of the United States is:

1. The method of charging gas under pressure into the gas port of a pressure reservoir and inserting a sealing member into such port comprising the steps of positioning the sealing member loosely in the gas port, forcing gas under pressure into the gas port past the loosely fitting sealing member and after the reservoir is filled with gas under pressure, while still maintaining such gas pressure, forcing the sealing member into the gas port to seal the latter.

2. The method recited in claim 1 in which the sealing member is expanded by moving an expander member thereinto while it is being forced into the gas port to define a gas-tight seal.

3. The method recited in claim 1 in which the gas compressed between the sealing member and the expander member is vented as the expander member is forced into the sealing member.

4. The method recited in claim 1 in which the sealing member is expanded by moving an expander member thereinto while it is being forced into the gas port to define a gas-tight seal, and the gas compressed between the expander member and the sealing member is vented as the expander member is forced into the sealing member, and thereupon the gas under pressure between the source thereof and the sealed gas port is vented.

5. Apparatus for charging gas under pressure into and sealing a pressure reservoir of the type having a gas port with a gas port fitting therein having a bore therethrough, the latter having a sealing bushing initially loosely positioned in the outer end thereof, comprising a pair of spaced parallel support members between which the pressure reservoir is positioned to retain said reservoir in fixed position, one of said support members having a bore with which the gas port is axially aligned, a sealing piston having a stem portion slidably mounted in said support member bore and a head portion adapted to react against the gas port fitting to define an annular seal around said gas port, a force exerting plunger coaxial with said sealing piston and axially aligned with said bushing, said sealing piston having an axial bore in which said plunger is slidably mounted, passage means in said sealing piston for flow of gas under pressure through said sealing piston, past said bushing into said reservoir to charge the latter, passage means in said support member for flow of gas under pressure into the support member bore, said passage means in said sealing piston being in communication with said support member bore and means to effect movement of said plunger against said bushing to force the latter into the bore of said gas port fitting to seal the latter.

6. The combination set forth in claim 5 in which said sealing bushing is cup-shaped having a deformable side wall and an expander member is initially positioned in the mouth of the bushing, said plunger reacting against said expander member to move the latter into the bushing to expand the latter while forcing the bushing into the bore of the gas port fitting.

7. The combination set forth in claim 5 in which said plunger has a head at one end, and additional passage means is provided in said support member for flow of oil under pressure into the support member bore to react against the plunger head on the side thereof opposed to said piston.

8. The combination set forth in claim 7 in which said plunger head has an annular peripheral groove in which an "0" ring is mounted to provide a seal between the oil forced into the support member bore on one side of the plunger head and the gas forced into the support member bore on the other side of the plunger head.

9. The combination set forth in claim 5 in which the other support member is vertically adjustable to permit accommodation of pressure reservoirs of different axial lengths therebetween.

10. The combination set forth in claim 5 in which the sealing piston head has an annular groove in its outer surface coaxial with the gas port and an "0" ring is positioned in said annular groove.

11. The combination set forth in claim 5 in which means are provided to relieve the gas pressure between the plunger head and the sealing piston after the gas port bore has been sealed.

* * * * *